US009639870B2

(12) United States Patent
Keshkamat et al.

(10) Patent No.: US 9,639,870 B2
(45) Date of Patent: May 2, 2017

(54) DOCUMENT TRACKING TOOL

(71) Applicant: Accenture Global Services Limited, Dublin (IE)

(72) Inventors: Sameer Keshkamat, Bangalore (IN); Prabir GhoushalKumar, Bangalore (IN); Gautam Choudhury, Bangalore (IN); Suhail Hagalwadi, Bangalore (IN)

(73) Assignee: Accenture Global Services Limited, Dublin (IE)

( * ) Notice: Subject to any disclaimer, the term of this patent is extended or adjusted under 35 U.S.C. 154(b) by 388 days.

(21) Appl. No.: 13/842,755

(22) Filed: Mar. 15, 2013

(65) Prior Publication Data

US 2014/0279322 A1 Sep. 18, 2014

(51) Int. Cl.
*G06Q 30/00* (2012.01)
*G06Q 30/04* (2012.01)

(52) U.S. Cl.
CPC ..... *G06Q 30/04* (2013.01)

(58) Field of Classification Search
CPC .. H04N 1/4051; H04N 1/4055; H04N 1/4092; G06K 15/02; G06F 3/12; G06Q 10/06
USPC ..... 705/32, 7.22; 385/1.13, 1.15
See application file for complete search history.

(56) References Cited

U.S. PATENT DOCUMENTS 5,528,705 A * 6/1996 Reasoner, Jr. ..... G06T 9/007 348/159
6,044,384 A * 3/2000 Ishima et al. ..... 715/210
6,259,829 B1 * 7/2001 Bleecker, III ..... G06T 9/007 358/410
6,782,345 B1 * 8/2004 Siegel et al. ..... 702/183
2002/0067497 A1 * 6/2002 Thieret et al. ..... 358/1.13
2003/0046639 A1 * 3/2003 Fai ..... G06Q 10/10
2003/0227643 A1 * 12/2003 Reddy et al. ..... 358/1.13
2004/0156066 A1 * 8/2004 Mishima ..... H04N 1/32101 358/1.13
2006/0036612 A1 * 2/2006 Harrop et al. ..... 707/100
2006/0248579 A1 * 11/2006 Gerritsen et al. ..... 726/9
2007/0186216 A1 * 8/2007 Seifi ..... 718/102
2007/0192176 A1 * 8/2007 Onischuk ..... 705/12
2007/0279677 A1 * 12/2007 Su et al. ..... 358/1.15
(Continued)

OTHER PUBLICATIONS

Australian Office Action in Australian Application No. 2014201566, mailed Apr. 17, 2014, 4 pages.

*Primary Examiner* — Seye Iwarere
(74) *Attorney, Agent, or Firm* — Fish & Richardson P.C.

(57) ABSTRACT

Tracking technology, in which document information for at least one document received for processing by a document processing system is obtained. The document processing system is configured to process the at least one document in stages that are performed by at least two different applications operated by at least two separate hardware systems. Status updates indicative of processing of the at least one document in each of the stages are obtained. A progress of the processing of the at least one document in each of the stages based on the status updates is tracked. The at least one document meets one or more pre-defined processing requirements related to the processing are evaluated. Information about the stages of the processing of the at least one document based on the tracked progress and the evaluation is reported.

20 Claims, 13 Drawing Sheets

(56) References Cited

U.S. PATENT DOCUMENTS

| | | | | |
|---|---|---|---|---|
| 2007/0285674 | A1* | 12/2007 | Shahindoust et al. | 358/1.1 |
| 2008/0222186 | A1* | 9/2008 | Cozianu et al. | 707/102 |
| 2008/0291486 | A1* | 11/2008 | Isles et al. | 358/1.15 |
| 2009/0132589 | A1* | 5/2009 | Daos et al. | 707/104.1 |
| 2010/0083057 | A1 | 4/2010 | Laxminarayanan | |
| 2011/0286037 | A1* | 11/2011 | Hamada | 358/1.15 |
| 2014/0164044 | A1* | 6/2014 | DeRoller | G06Q 10/103 705/7.22 |

* cited by examiner

DOCUMENT TRACKING TOOL

FIELD

This disclosure relates to tracking technology.

BACKGROUND

Documents may be processed for various purposes. For example, invoices may be processed to ensure that payments for the invoices are made.

SUMMARY

In one general aspect, a document tracking system includes at least one processor and at least one memory coupled to the at least one processor having stored thereon instructions which, when executed by the at least one processor, causes the at least one processor to perform operations. The operations include obtaining document information for at least one document received for processing by a document processing system, the document processing system being configured to process the at least one document in stages that are performed by at least two different applications operated by at least two separate hardware systems. The operations also include obtaining status updates indicative of processing of the at least one document in each of the stages, tracking a progress of the processing of the at least one document in each of the stages based on the status updates, evaluating whether the at least one document meets one or more pre-defined processing requirements related to the processing, and reporting information about the stages of the processing of the at least one document based on the tracked progress and the evaluation.

Implementations may include one or more of the following features. For example, tracking the progress may include tracking data that describes, for each of the at least one document, one or more completed stages of the stages, an in progress stage of the stages, and one or more next stages of the stages, where reporting information includes presenting the tracking data.

Obtaining the status updates may include receiving, from each of the at least two separate hardware systems, the status updates associated with the stages performed by the at least two different applications operated by the at least two separate hardware systems.

Obtaining the status updates may include, for each stage that has been completed for a document, receiving a start time describing when processing of the document in the stage was begun and an end time describing when processing of the document in the stage was completed.

Obtaining the status updates may include, for each stage that has been begun processing for a document, receiving a start time describing when processing of the document in the stage was begun.

Obtaining the status updates may include obtaining, for each stage, the unique reference number for each document being processed by the stage, where tracking the progress includes, for each document, determining the stage of processing the document based on the unique reference number of the document in the status updates.

Obtaining the document information may include obtaining at least one document or at least one indication that identifies at least one document received for processing by the document processing system.

Evaluating may include comparing the progress of the processing to the one or more pre-defined processing requirements, detecting that the processing is estimated to fail to satisfy the one or more pre-defined processing requirements based on the comparison, and generating an alert based on the detection.

Comparing may include determining that an estimated processing time for remaining stages is greater than a time remaining for processing based on the one or more pre-defined processing requirements.

The operations may further include determining the estimated process time for the remaining stages based on obtained status updates.

Obtaining document information for at least one document received for processing by a document processing system may include obtaining document information for at least a physical paper, a writing conveying information, a computer file containing information, product packaging, images, or video.

Reporting information may include providing the information, to a client device, that enables the client device to display to a user a summary of different documents being processed that have failed to satisfy one or more pre-defined processing requirements.

Reporting information may include receiving a search query identifying the at least one document and providing information regarding the progress of the at least one document in response to the query. In some implementations reporting information may further include providing an interface to a client device for a user to input the search query.

Reporting information may include providing a summary of processing progress of different documents by customer.

The operations may be performed in a real-time manner.

The system may further include a status database storing the obtained status updates, and a requirement database storing the one or more pre-defined processing requirements.

The two different applications may include different stages.

In another general aspect a method includes obtaining document information for at least one document received for processing by a document processing system, the document processing system being configured to process the at least one document in stages that are performed by at least two different applications operated by at least two separate hardware systems. The method also includes obtaining status updates indicative of processing of the at least one document in each of the stages, tracking a progress of the processing of the at least one document in each of the stages based on the status updates, evaluating whether the at least one document meets one or more pre-defined processing requirements related to the processing, and reporting information about the stages of the processing of the at least one document based on the tracked progress and the evaluation.

In yet another general aspect at least one computer-readable storage medium is encoded with executable instructions that, when executed by at least one processor, cause the at least one processor to perform operations that include obtaining document information for at least one document received for processing by a document processing system, the document processing system being configured to process the at least one document in stages that are performed by at least two different applications operated by at least two separate hardware systems. The operations further include obtaining status updates indicative of processing of the at least one document in each of the stages, tracking a progress of the processing of the at least one document in each of the stages based on the status updates, evaluating whether the at least one document meets one or more pre-defined processing requirements related to the processing, and reporting information about the stages of the processing of the at least one document based on the tracked progress and the evaluation.

The details of one or more implementations are set forth in the accompanying drawings and the description, below. Other potential features and advantages of the disclosure will be apparent from the description and drawings, and from the claims.

DETAILED DESCRIPTION

Documents may be processed for a variety of purposes. A document may include a physical paper, a writing conveying information, or a computer file containing information, etc. A document may also include things that would not be considered a traditional document, for example, product packaging, images, or video, etc. For example, documents may be processed for invoice processing, claims processing, or human resource processing, etc. Document processing may be a time and resource consuming time that may be outsourced by companies. For example, a company, e.g., a customer, may contract with a service provider through service-level agreements (SLA) for the service provider to process documents for the company according to various processing requirements. The processing requirements may specify requirements the service provider has contracted to satisfy when processing documents. For example, the processing requirement may specify that all documents should be processed within a pre-determined length of time, e.g., a day, a week, a month, etc.

The service provider and the customer may wish to determine information regarding the documents the service provider is processing for the customer. For example, the customer may wish to determine how many documents the service provider has processed within a predetermined amount of time, how many documents are currently being processed, the status of processing for documents, or how many documents are close to failing to satisfy specified requirements, etc. Alternatively or additionally, the service provider may also wish to determine similar information, for example, to respond to a verbal request for information from the customer or for internal business purposes. A document tracking system may enable the customer and the service provider to quickly determine information regarding document processing, e.g., track processing of documents processed by the service provider.

Figure 1:
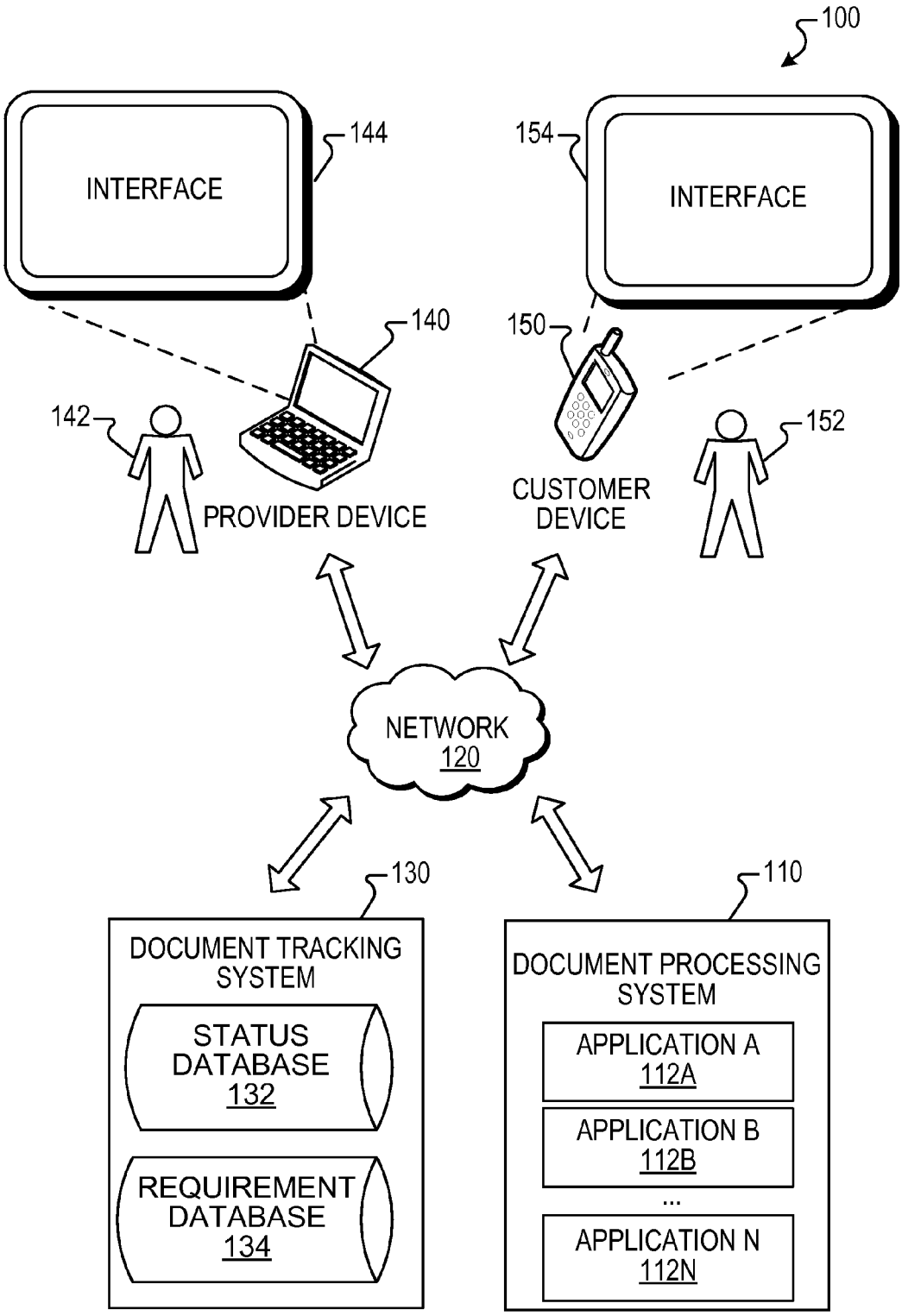
FIG. 1 illustrates a diagram of an exemplary system for document tracking.

FIG. 1 illustrates a diagram of an exemplary system 100 for document tracking. The system 100 includes a document processing system 110, network 120, a document tracking system 130, provider device 140, and customer device 150.

The document processing system 110 may be configured to process documents in stages that are performed by at least two different applications 112A-N operated by at least two separate hardware systems. For example, applications 112A-N may be N applications running on N corresponding separate hardware systems.

The applications 112A-N may be each configured to process documents from a particular customer. For example, application 112A may process documents from customer A and application 112N may process documents from customer N. The applications 112A-N may alternatively or additionally be configured to process specific types of documents from a particular customer. For example, application 112A may process invoices from customer A and application 1128 may process claims from customer A.

Applications 112A-N may alternatively or additionally be configured to process documents based on how the document processing system 110 receives the document. The document processing system 110 may include multiple methods for ingesting documents. For example, the document processing system 110 may ingest physical or electronic documents. Physical documents, e.g., documents received by mail, may be first scanned into the document processing system 110. Electronic documents, e.g., e-mail attachments of PDFs or images, faxes, etc., may be extracted and converted into an intermediate electronic format that may be more easily processed by the document processing system 110. The applications 112A-N may be specific to the method by which the documents are ingested.

The applications 112A-N may perform stages for processing documents. Stages may be modular and shared by applications 112A-N. For example, a stage may be assigning a uniform resource name (URN) to a document and this stage may be shared by all applications 112A-N. Another stage may be bar code detection for documents which may be performed by only applications 112A-N known to process documents with barcodes.

The separate hardware systems operating the applications 112A-N may be in communication with the document processing system 110. For example, the separate hardware systems may be connected together in the document processing system 110 by a network 120. The document processing system 110 may determine the relevant application for processing a document and communicate the document to the relevant application using network 120. Alternatively or additionally, the document processing system 110 may be separate from the separate hardware systems operating the applications 112A-N.

The document processing system 110 may provide status updates indicative of processing of documents by the document processing system 110. For example, the document processing system 110 may provide a status update at regular intervals, e.g., every minute, every half hour, every hour, or every day, for all documents being processed by the document processing system 110. The applications 112A-N may generate the status updates and provide the status updates to the document processing system 110 for the document processing system 110 to provide the status updates to the document tracking system 130.

The status update may describe the current stage that each document is being processed in, the start time for processing in that stage, and the end time for the stage that the document has just completed processing. Additionally or alternatively, the status update may include information for all stages, regardless if uninitiated, pending, or completed, or information for stages for which the status has changed, e.g., two or more stages have been completed since the last status update. Alternatively or additionally, the document processing system 110 may provide a status update when the status for processing a document changes, e.g., the processing for a document has moved to a next stage.

Alternatively or additionally, the document processing system 110 may provide a status update for each document. For example, the document processing system 110 may provide a status update for a single document when the stage of processing for the single document changes. Alternatively or additionally, the applications 112A-N may generate a status update for each document that each application is currently processing or has completed processing, and the document processing system 110 may forward the status updates generated by the applications 112A-N.

The document processing system 110 may provide document information for documents received for processing by the document processing system 110 to the document tracking system 130. The document information may be included in the status updates or may be separate from the status updates. Document information may include, for example, a URN, a client, a source, a batch identification, and an ingestion date, etc.

The URN may be a unique identifier for each document which may be used to associate information with the document. The client may designate the customer for which the document corresponds. The source may indicate the method by which the document is ingested. The batch identification may be a unique identifier for a batch of documents being processed together. The ingestion date may indicate the time and date which the document was ingested into the document processing system 110.

The document processing system 110 may be in communication with the document tracking system 130 by the network 120. For example, the document processing system 110 may provide status updates and document information to the document tracking system 130 using the network 120.

The document tracking system 130 may track the progress of document processing. The document tracking system 130 may obtain document information for documents received for processing by the document processing system 110. The document tracking system 130 may also obtain status updates indicative of processing of the documents in each of the stages for the applications 112A-N used by the document processing system 110 for processing the documents.

The document tracking system 130 may include a status database 132 and a requirement database 134. The status database 132 may store information regarding status updates received by the document tracking system 130. For example, the status database 132 may include the actual status updates. Alternatively or additionally, the status database 132 may include information derived from the status updates, e.g., time when update received.

The requirement database 134 may store information regarding pre-defined processing requirements for processing documents. For example, the requirement database 134 may store processing requirements. The processing requirements may specify requirements the service provider has contracted to satisfy when processing documents.

Processing requirements may be referred to as key performance indicators (KPIs). The KPIs stored in the requirement database 134 may include KPIs regarding latency in processing documents. For example, the KPI may designate that documents should be processed within a pre-determined length of time, e.g., a day, a week, a month, etc.

The document tracking system 130 may be configured to evaluate whether documents meet the processing requirements stored in the requirement database 134. The document tracking system 130 may compare information stored in the status database 132 to the processing requirements stored in the requirement database 134 to determine if processing requirements have been satisfied or not satisfied.

For example, the document tracking system 130 may compare the length of time that a document has been processed to a maximum length of time for processing designated by a processing requirement to determine if the processing time is less than the maximum length of time.

Alternatively or additionally, the document tracking system 130 may detect that the processing is estimated to fail to satisfy the processing requirements based on a comparison and generate an alert based on the detection. For example, the document tracking system 130 may determine that processing in a document has been in a single stage for an abnormally long period of time, which may indicate that the processing may be stuck in that stage and manual intervention is required.

In another example, the document tracking system 130 may determine that the length of time left to process a document is insufficient based on an estimated length of time needed to process documents for the remaining stages in the document processing. A determination of an insufficient length of time may indicate that additional resources may need to be allocated to completely process the document within the length of time left. The document tracking system 130 may determine the estimated length of time needed to process documents for the remaining stages based on pre-set lengths of time or statistical information, e.g., average, median, etc., based on previous status updates.

The document tracking system 130 may report information about the stages of processing of documents based on the tracked progress and the evaluation. For example, the document tracking system 130 may generate a report including the information. The document tracking system 130 may provide the information to a provider device 140 and customer device 150 using the network 120.

The provider device 140 may be a device used by a provider user 142 to interact with the document tracking system 130 to track progress of document processing. The provider device 140 may be a portable computing device, e.g., laptop, tablet, mobile phone, etc., or may be a non-portable computing device, e.g., a desktop computer. The provider device 140 may provide an interface 144 for the provider user 142 to interact with the document tracking system 130. For example, the interface 144 may enable the provider user 142 to request and view information regarding document processing progress.

The customer device 150 may be a device used by a customer user 152 to interact with the document tracking system 130 to track progress of document processing. The customer device 150 may also be a portable computing device, e.g., laptop, tablet, mobile phone, etc., or may also be a non-portable computing device, e.g., a desktop computer. The customer device 150 may also provide an interface 154 for the customer user 152 to interact with the document tracking system 130. The interface 154 may be similar to the interface 144 for the provider user 142, except the interface 154 for the customer user 152 may be limited in access to view only information associated with the customer and no other customers of the service provider. Alternatively or additionally, the interface 154 may also enable the customer user 152 to provide documents to the document processing system 110 for processing.

Figure 2:
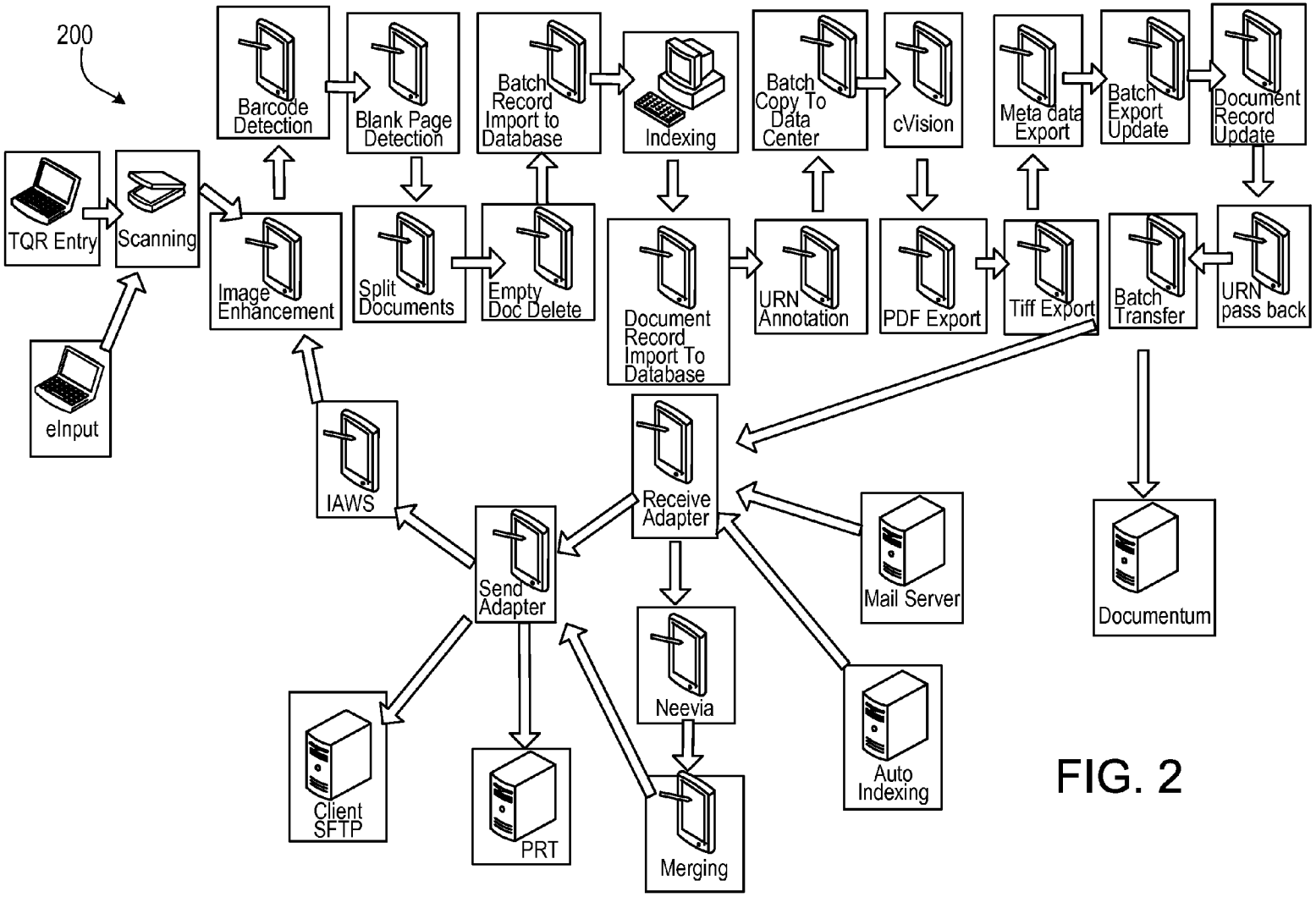
FIG. 2 illustrates a diagram of exemplary stages for processing a document.

FIG. 2 illustrates a diagram of exemplary steps 200 for processing a document using the document processing system 110. The steps 200 may include eighteen steps across six different products. For example, images of documents may be obtained, images may be enhanced, barcodes may be detected, blank pages deleted, documents split, empty documents deleted, etc. The document tracking system 130 may enable users 142 and 152 to determine the stage that a document is currently being processed in. Stages may directly correspond to the steps 200 shown, or each stage may include portions of steps 200 or multiple steps 200 combined together. The document processing system 110 may use the steps 200 or other steps based on the document being processed. For example, based on the document being processed, the processing system 110 may proceed through the steps 200 in a different order, skip particular steps, or perform additional steps. Accordingly, the steps 200 may be customized to the process.

Figure 3:
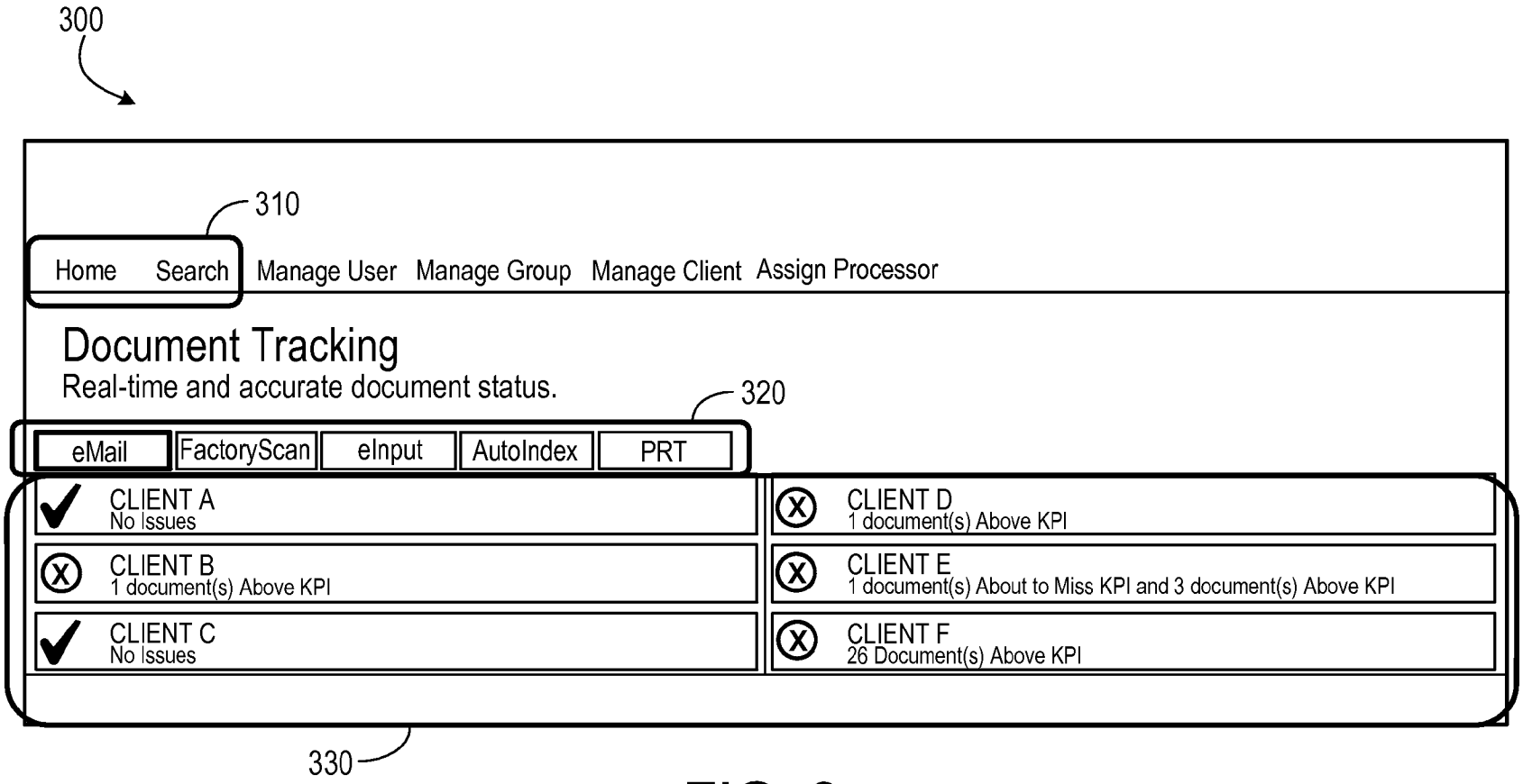
FIG. 3 illustrates an exemplary interface for document tracking.

FIG. 3 illustrates an exemplary interface 300 for document tracking. The interface 300 includes a menu bar 310, ingestion tabs 320, and a tab pane 330. The menu bar 310 includes menu options, which may include, among other options, "Home" and "Search." The interface 300 shows an example of when "Home" is selected.

The ingestion tabs 320 include tabs for the different methods of ingesting documents into the document processing system 110. The ingestion tabs 320 may include tabs for e-mail, FactoryScan, elnput, AutoIndex, and PRT. Different sets of ingestion tabs may be used based on the different methods of ingesting documents available to a document processing system. Interface 300 shows an example where the ingestion tab 320 for e-mail is selected.

The tab pane 330 may show information based on the selected ingestion tab 320. Interface 300 shows a tab pane 330 showing information for documents ingested using e-mail. The tab pane 330 shows document information grouped by customer. In tab pane 330 six customers are shown. Interface 300 may be an interface seen by a provider user 142 and not a customer user 152. The customer user 152 may be restricted from seeing document information for other customers.

A summary of processing of documents for each client may be shown in tab pane 330. For example, the number of currently processing documents may be shown. The number of processes above KPIs and the number of processes about to miss KPIs may be separately included in the summary so that provider users 142 may quickly see which customers may have problems. The summaries may additionally or alternatively include a single overall icon indicating the status of processing of documents for the customer. For example, an icon of a check mark may be shown if there are no pending processes, an "x" may be shown if all processes are above a KPI, and an exclamation mark may be shown if a process is about to miss a KPI.

Figure 4:
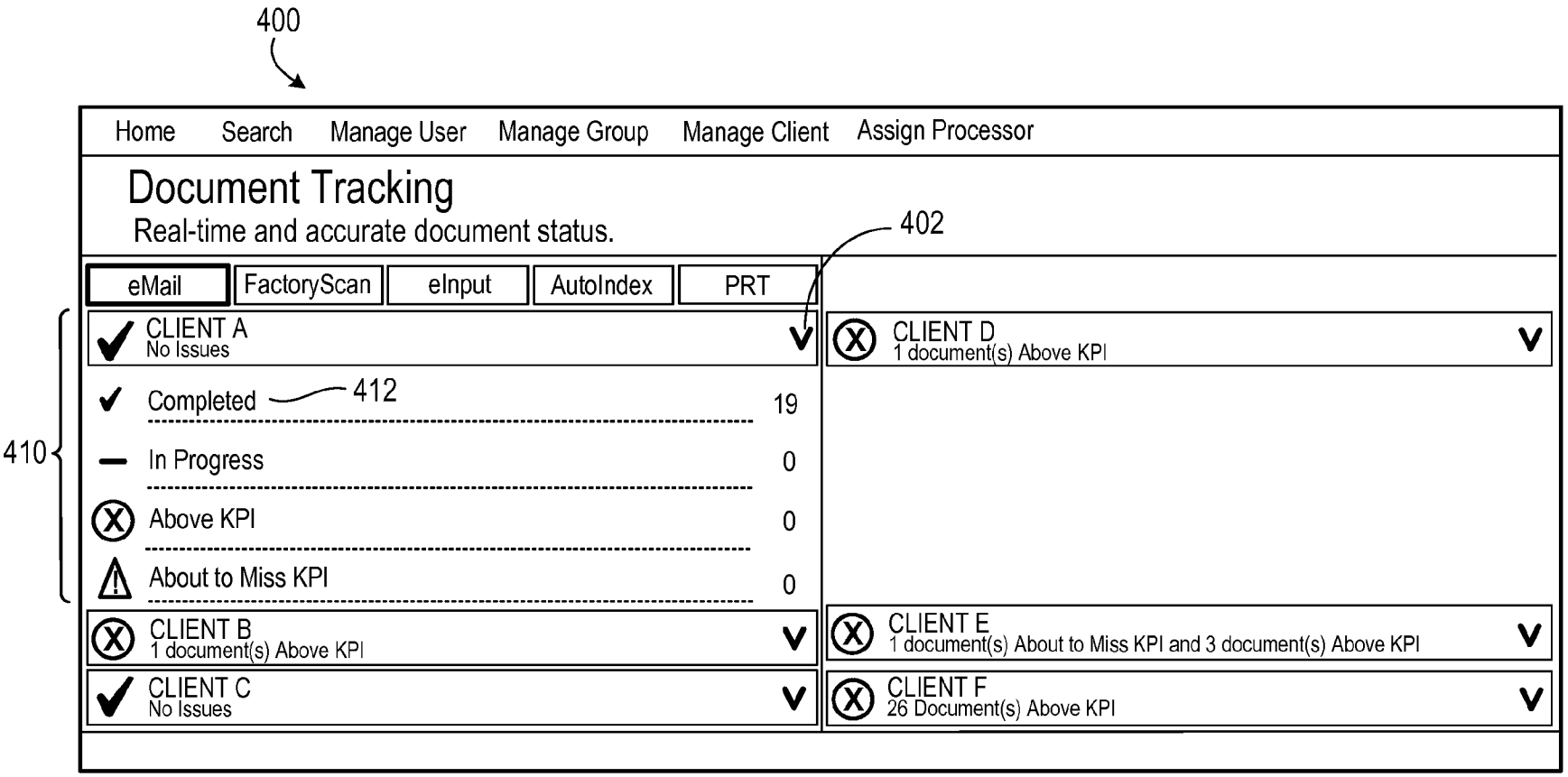
FIG. 4 illustrates an exemplary interface showing document tracking totals for a client.

FIG. 4 illustrates an exemplary interface 400 showing document tracking totals for a customer. The area for each customer may include an area that a user may interact with to view document tracking totals for a customer. For example, interface 400 may show each client with an arrow that may be clicked to expand the area to show document tracking totals in a document tracking totals area 410.

Document tracking totals for the customer may include the number of completed document, the number of in progress documents, the number of documents above KPIs, and the number of documents about to miss KPIs. As shown in interface 400, the number of completed documents may be shown in a completed document area 412 inside the document tracking totals area 410.

Figure 5:
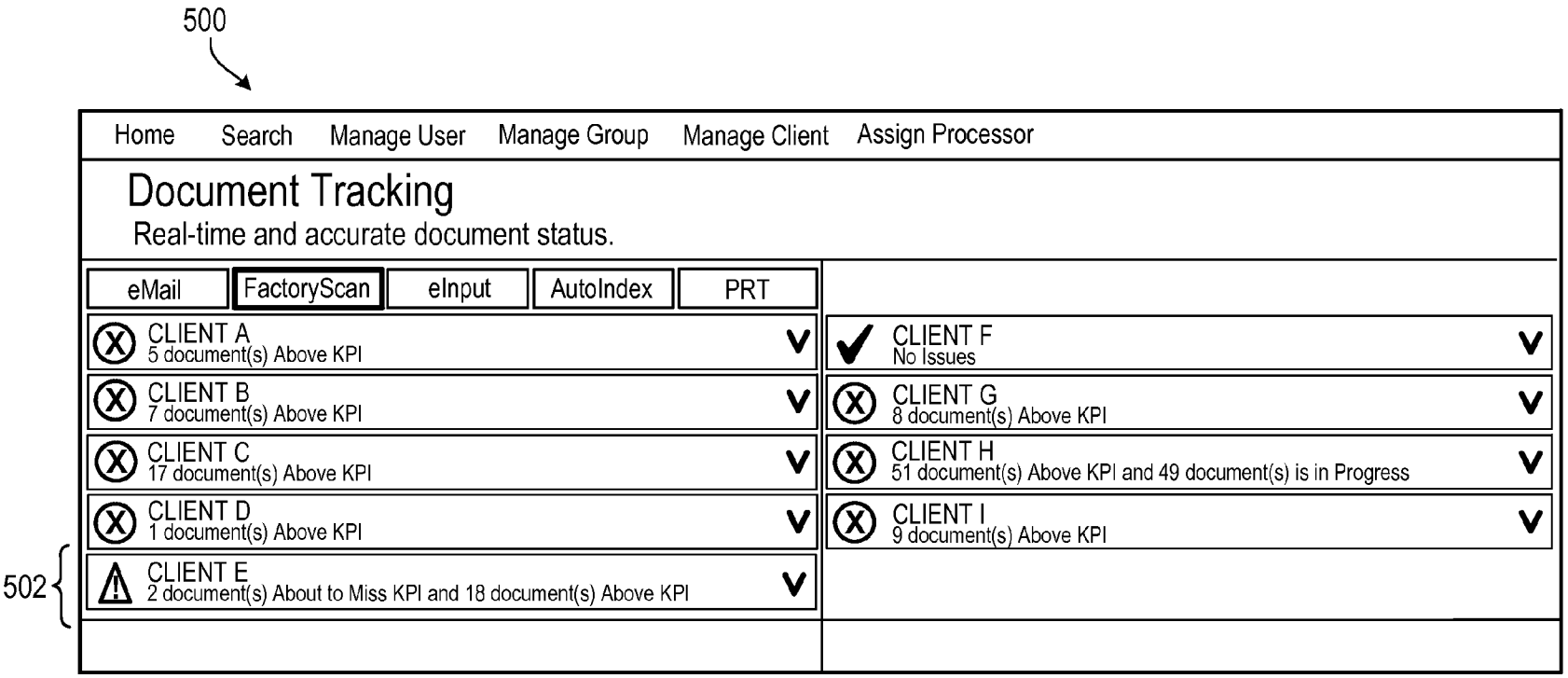
FIG. 5 illustrates an exemplary interface showing an alert.

FIG. 5 illustrates an exemplary interface 500 showing an alert. The interface 500 shows a tab for FactoryScan selected where the alert appears as a hazard icon within client area 502.

Figure 6:
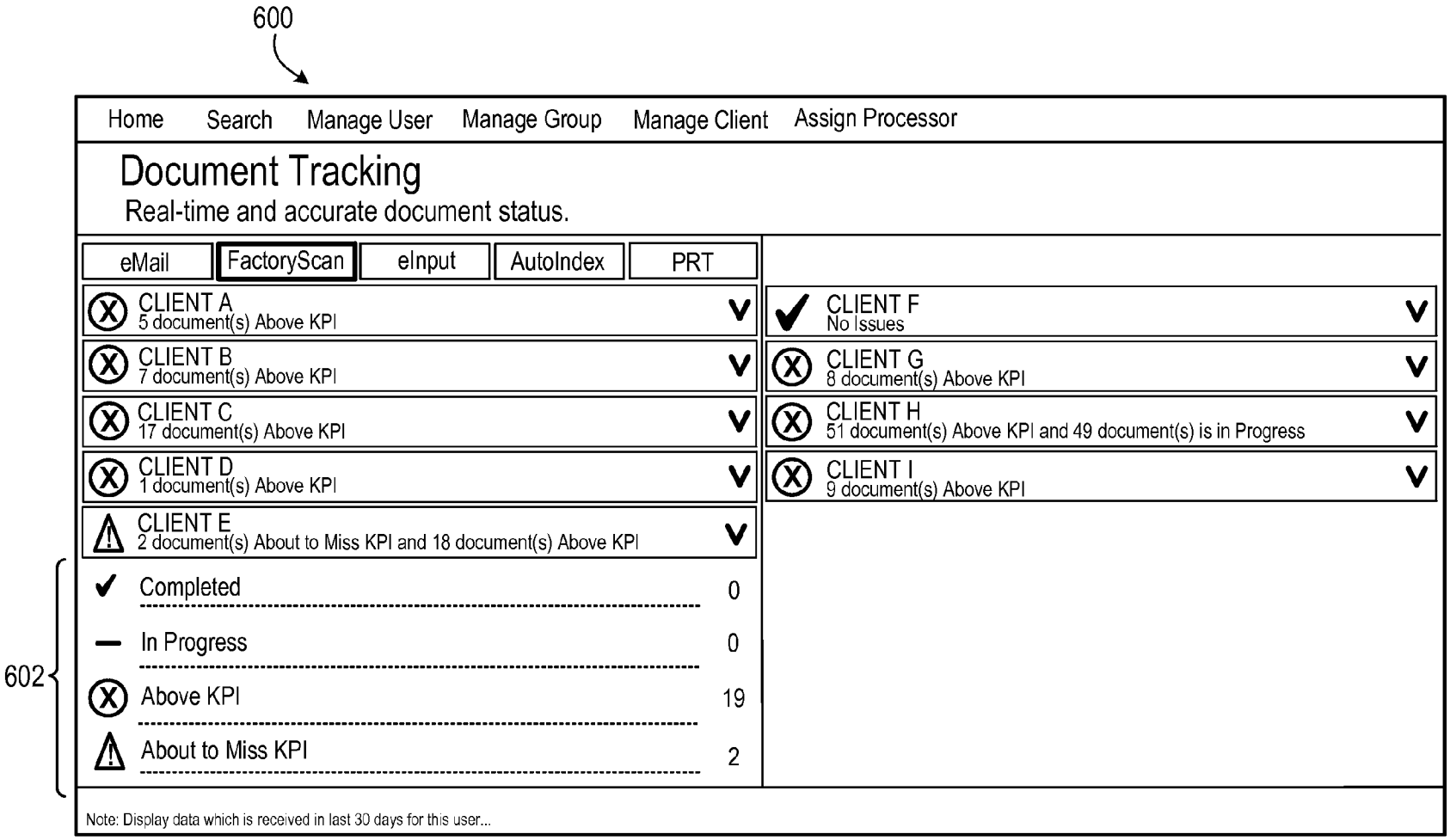
FIG. 6 illustrates an exemplary interface showing document tracking totals including alerts for a client.

FIG. 6 illustrates an exemplary interface 600 showing document tracking totals including alerts for a customer. The interface 600 shows a document tracking totals area 602 for the customer showing that two documents are about to miss KPIs.

Figure 7:
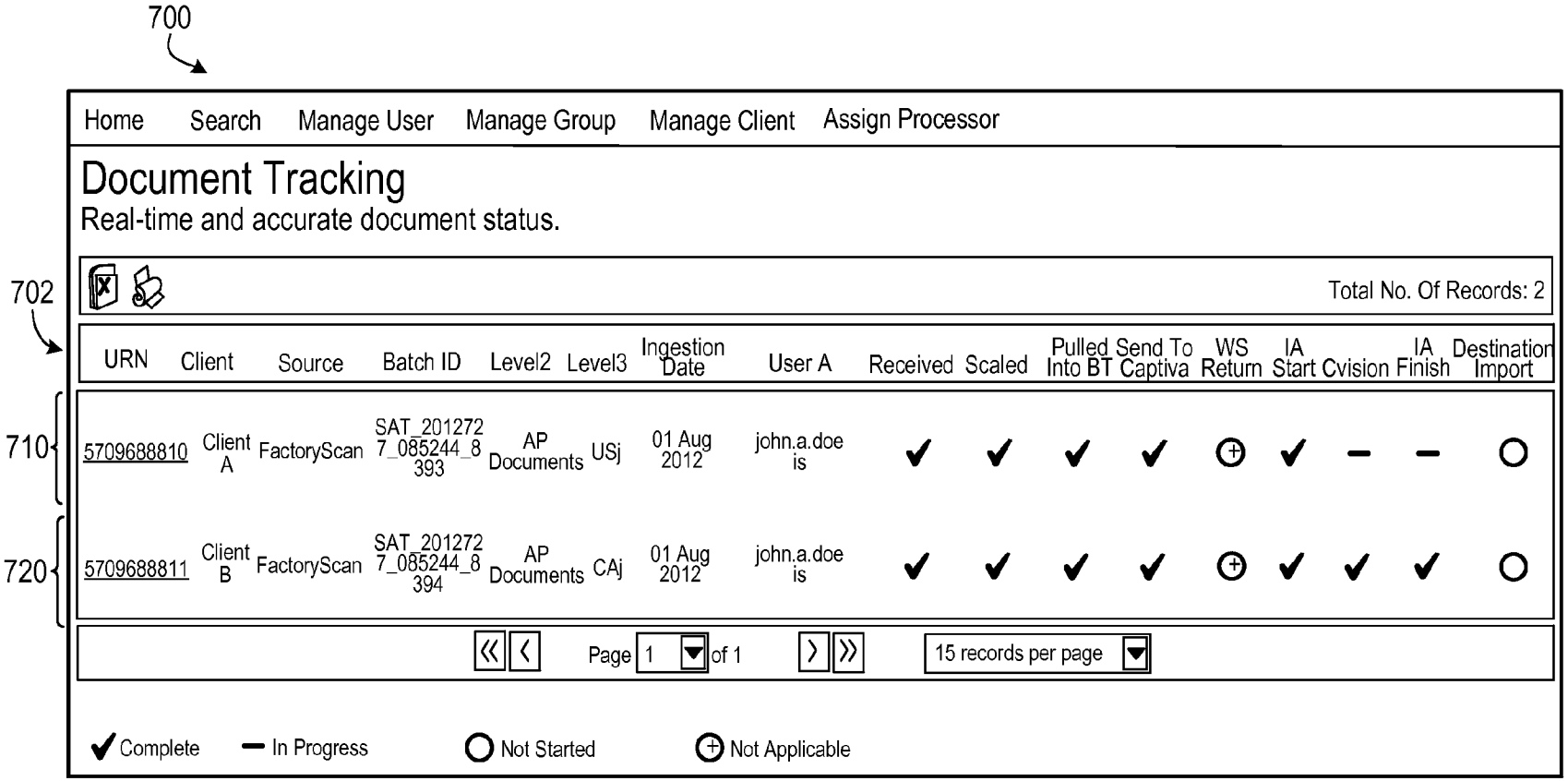
FIG. 7 illustrates an exemplary interface showing document tracking details for documents with alerts.

FIG. 7 illustrates an exemplary interface 700 showing document tracking details for documents with alerts. The interface 700 includes a table 702 showing the tracked progress for two documents. The interface 700 may be shown, for example, by clicking on the document tracking totals area 602 in FIG. 6 corresponding to documents about to miss KPIs.

The table 702 is shown with two documents in separate areas 710 and 720. The table may include columns for a URN, client, source, batch ID, Level2, Level3, Ingestion Date, Scanned User Name for each document. In regards to the status, the table may also include columns for stages of received, scanned, pulled into batch transfer, sent to Captiva, WS Return, IA Start, Cvision, IA Finish, and Destination Import. For each stage, the table may include an icon indicating the status of the stage. For example, the icons may include an icon for completed, in progress, not started, not applicable, etc.

Figure 8:
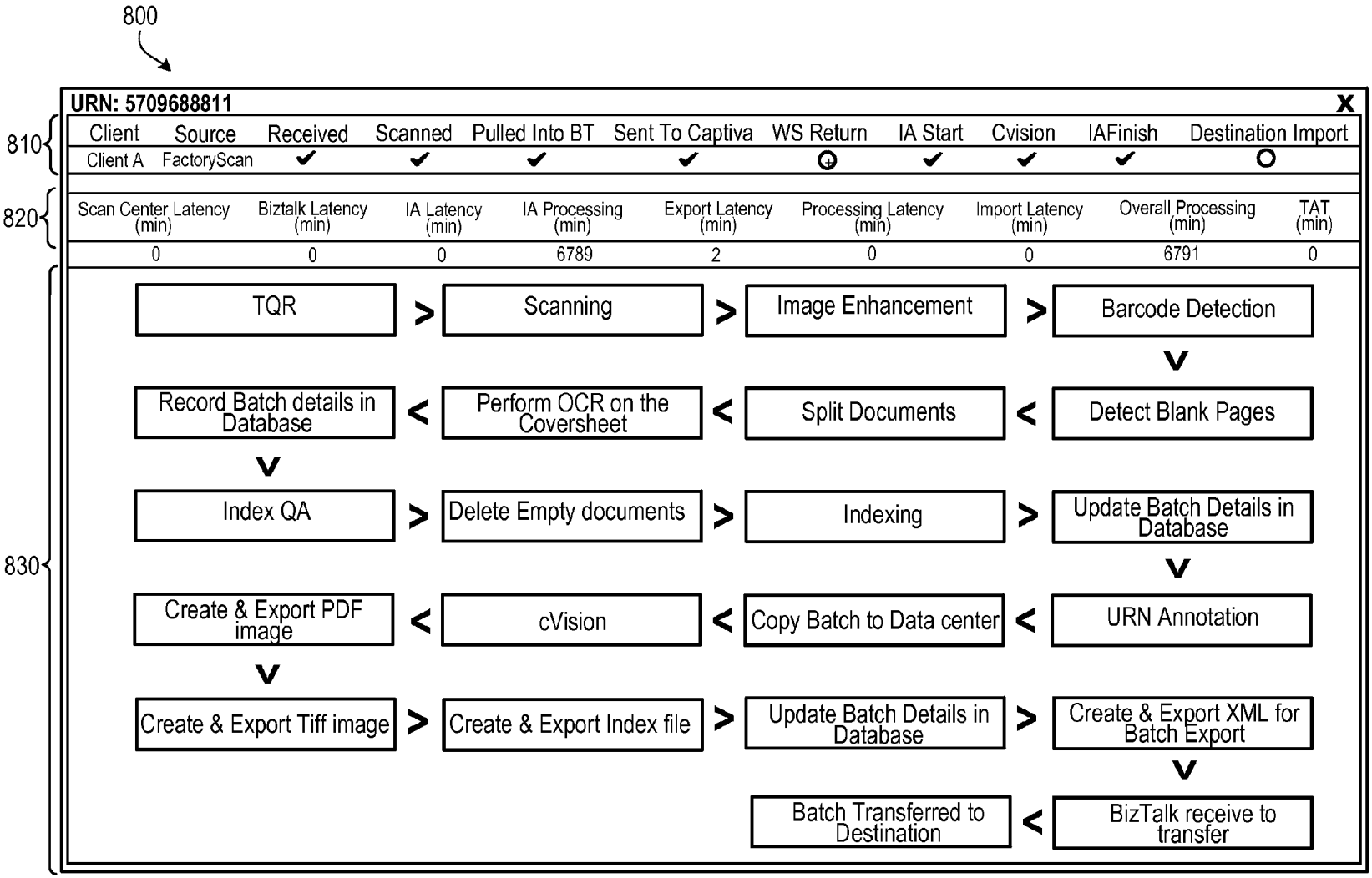
FIG. 8 illustrates an exemplary interface showing document tracking details by steps for a document.

FIG. 8 illustrates an exemplary interface 800 showing document tracking details by steps for a document. The interface 800 may include a stage status area 810, a latency area 820, and a steps area 830. The stage status area 810 may show the status of each stage for the document. The status may be shown with icons similar to the icons used in interface 700 for the table 702. The latency area 820 may show the latency in minutes for the stages, steps, or a combination of various stages or steps. In interface 800, "IA Processing" is shown as having taken more than six thousand minutes, which may indicate that there is a problem with the IA processing. The steps area 830 may show the current progress of the processing in the context of a flowchart showing all the stages in the process. The steps area 830 may indicate completed steps, current steps, and next steps. For example, the steps area 830 may use different colors, sizes, or fonts to distinguish the status of the steps.

Figure 9:
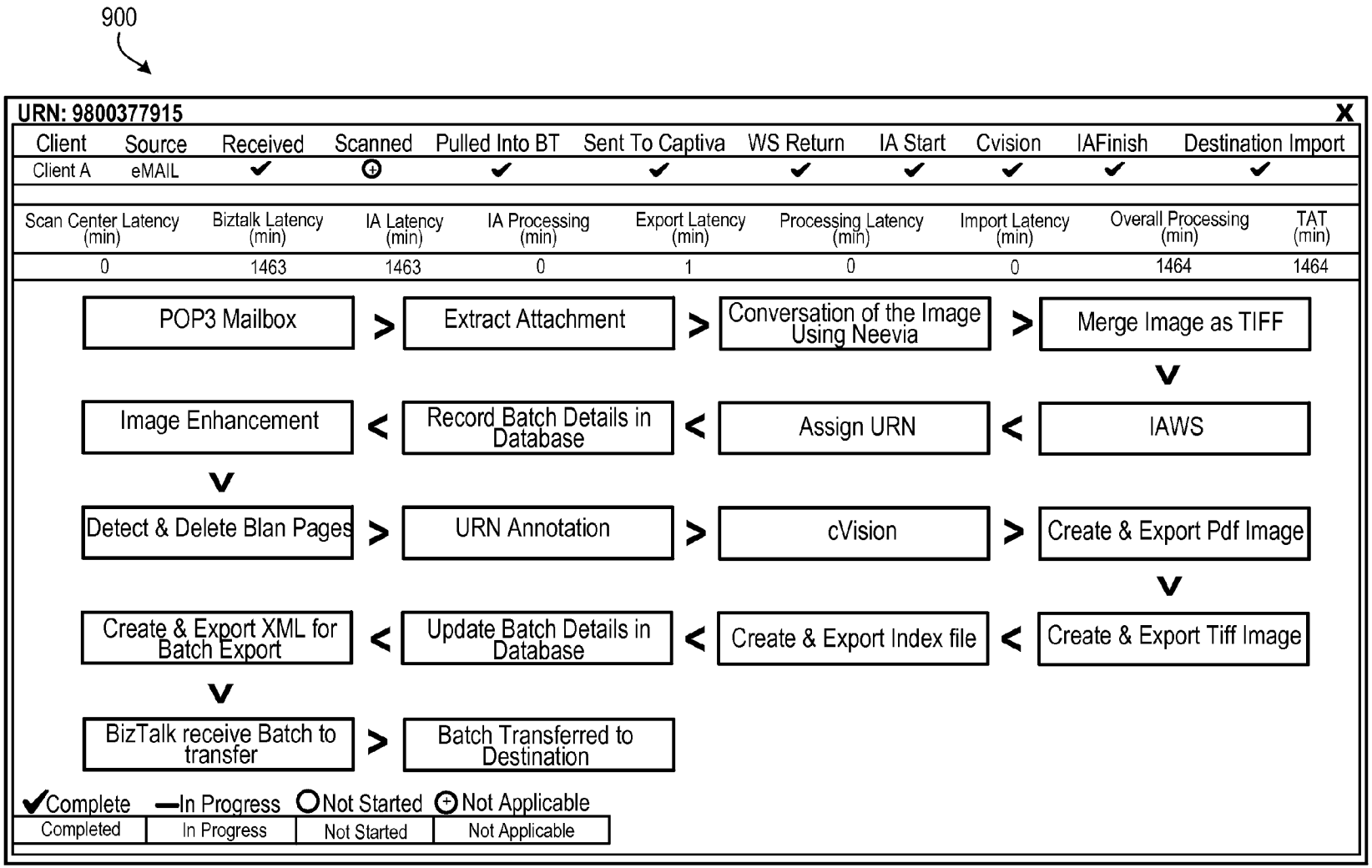
FIG. 9 illustrates an exemplary interface showing document tracking details by steps for an e-mail sourced document.

FIG. 9 illustrates an exemplary interface 900 showing document tracking details by steps for an e-mail sourced document. The interface 900 may appear similar to the interface 800. However, interface 900 shows how a document ingested using a different method, e.g., the source is e-mail instead of FactoryScan, may use different steps for processing.

Figure 10:
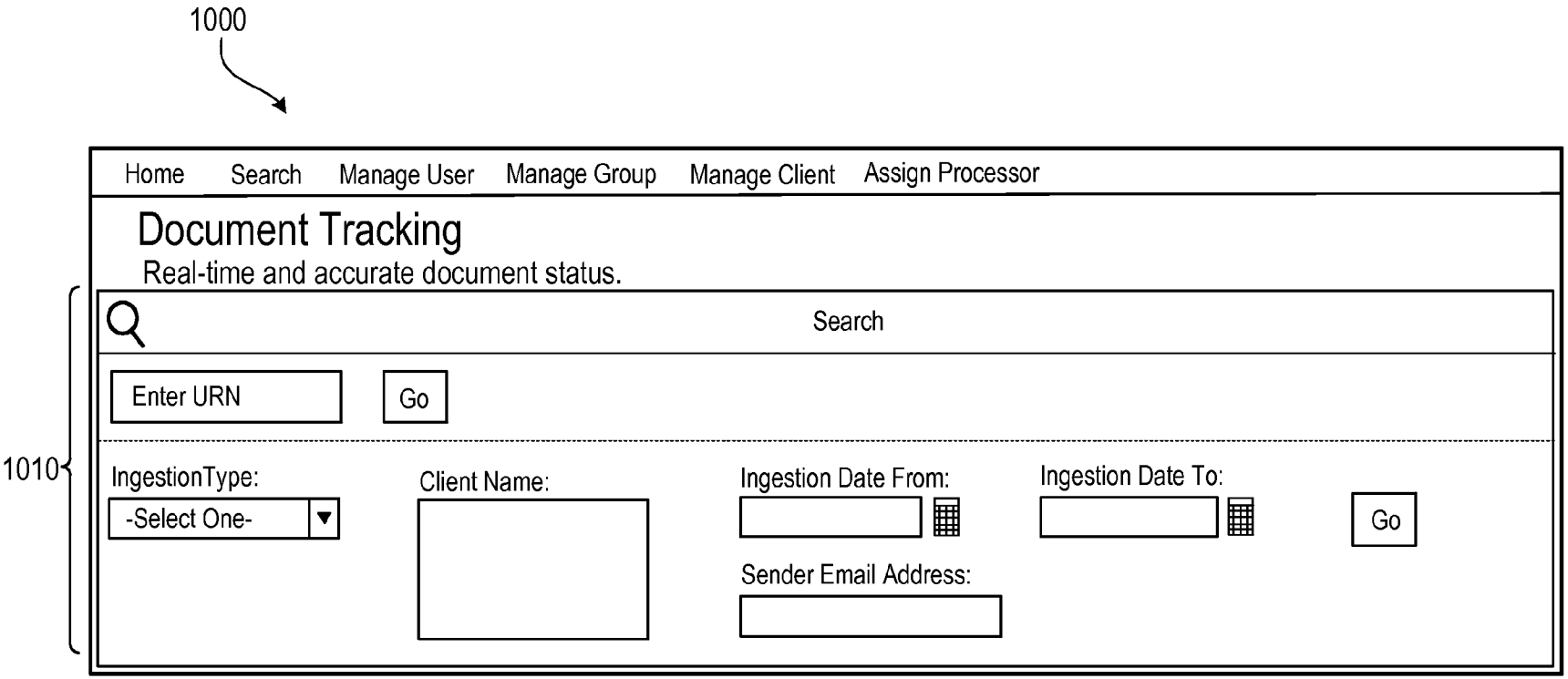
FIG. 10 illustrates an exemplary interface showing fields for searching for documents.

FIG. 10 illustrates an exemplary interface 1000 showing fields for searching for documents. The document tracking system 130 may provide the interface 1000 for provider users 142 and customer users 152 to search for documents.

The interface 1000 may be accessed by interacting with a menu option for "Search" in a menu bar. The interface includes a search area 1010. The search area 1010 includes interface elements for a user to designate information to search for documents. For example, users may be able to designate a URN, a sender's e-mail, an ingestion type, a client name, an ingestion date range, etc.

Figure 11:
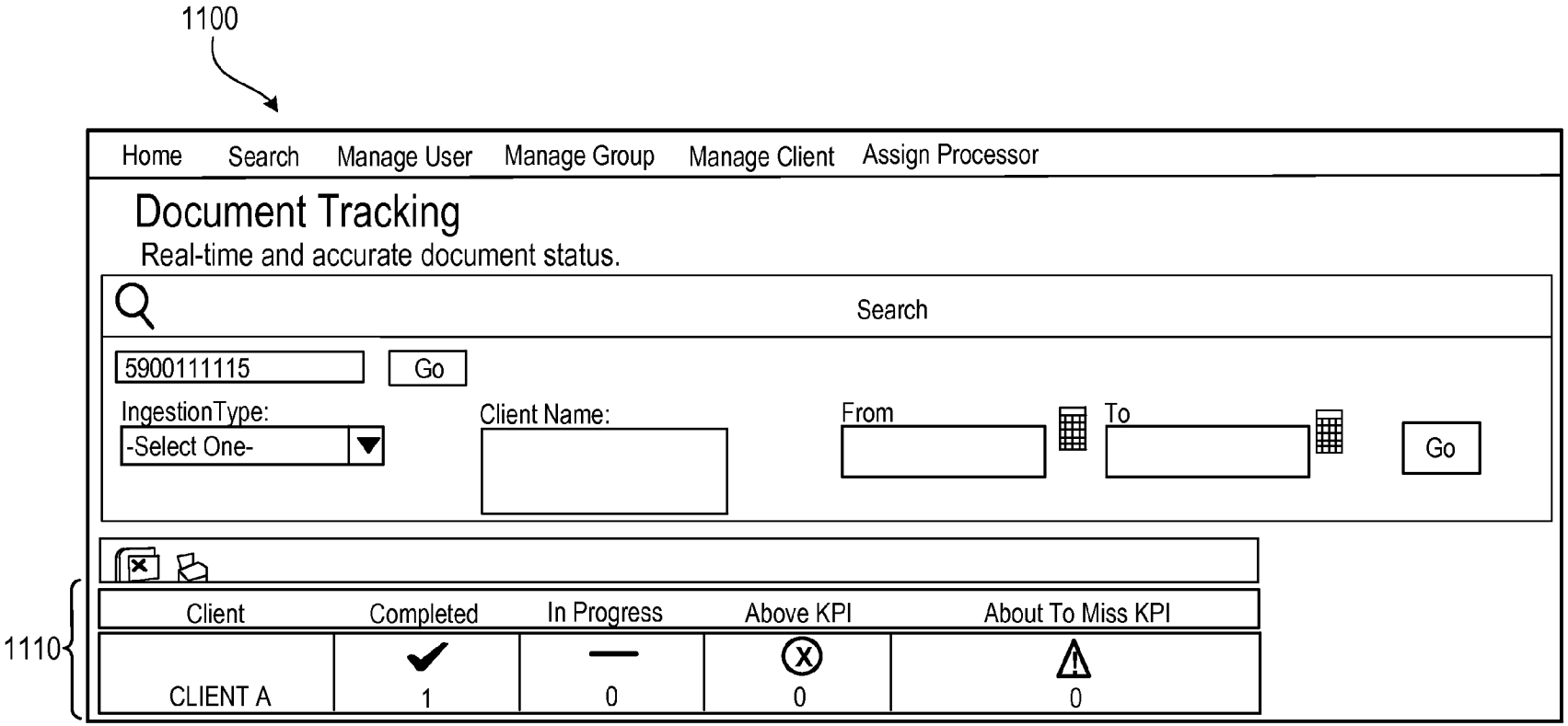
FIG. 11 illustrates an exemplary interface showing results of a search for a document.

FIG. 11 illustrates an exemplary interface 1100 showing results of a search for a document. The interface 1100 includes a search results area 1110. The search results area 1110 may show the results of the search. The search results area 1110 shows a client, number of completed documents, number of in progress documents, number of documents above KPI, and number of documents about to miss KPI.

The interface 1100 shows the results of searching for a particular URN. As expected given that the URN is unique, the search results area 1110 shows one document. The status of the document is shown as completed.

The interfaces described above may allow users of the system 100 to quickly identify problems areas, for example, stages or types of documents that have excessively long processing times. The problem areas may then be addressed to improve the system 100. For example, types of documents may be processed by additional hardware. The interfaces may also allow users to quickly determine past performance in processing of documents. For example, the interfaces may allow users to quickly determine how many documents were processed by the system 100, and the number of documents that satisfied KPIs, The past performance information may be used for business purposes, for example, the renegotiate SLAs. The interfaces may also allow users to perform volume analysis, e.g., to identify stages where problems may occur in the future if document volume increases or estimate remaining capacity to process documents within requirements.

Figure 12:
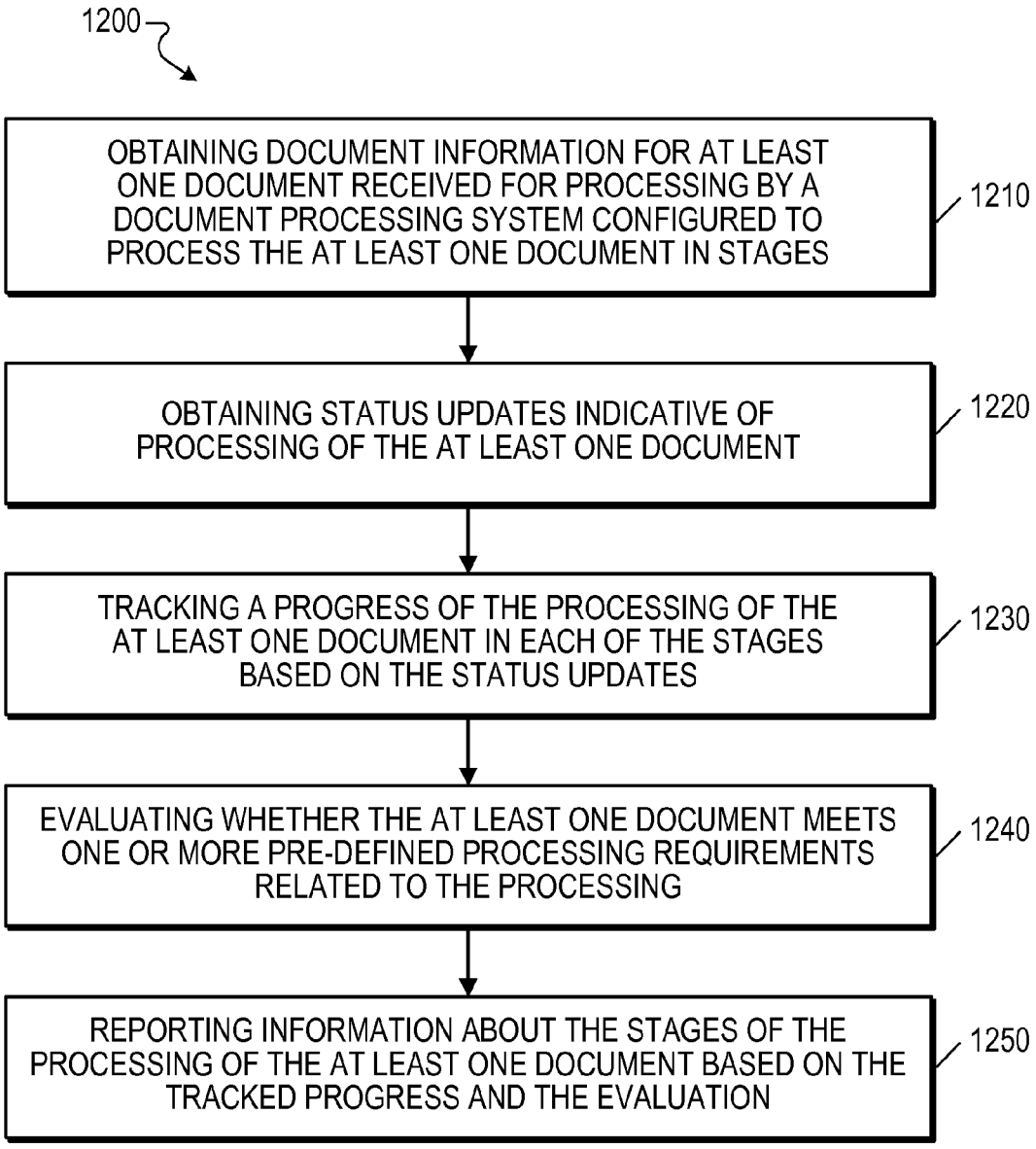
FIG. 12 illustrates an exemplary process for document tracking.

FIG. 12 illustrates an exemplary process 1200 for document tracking. The operations of the process 1200 are described generally as being performed by the system 100. In some implementations, operations of the process 1200 may be performed by one or more processors included in one or more electronic devices.

The process 1200 may include obtaining document information for at least one document received for processing by the document processing system 110 (1210). The document processing system 110 may be configured to process the at least one document in stages. As described above, the document information may include, for example, a URN, a client, a source, a batch identification, and an ingestion date, etc. The document tracking system 130 may obtain the document information from the document processing system 110.

The process 1200 may include obtaining status updates indicative of processing of the at least one document (1220). For example, the document tracking system 130 may obtain status updates from the document processing system 110. As described above, the document processing system 110 may provide status updates to the document tracking system 130 at regular intervals or in response to changes in statuses. Obtaining status updates may include obtaining, for each stage, URNs for each document being processed by the stage.

The process 1200 may include tracking a progress of the processing of the at least one document in each of the stages based on the status updates (1230). The document tracking system 130 may analyze the status updates obtained from the document processing system 110 and update a status indicating the progress of the processing. For example, the document tracking system 130 may update the status database 132 based on obtained status updates. The document tracking system 130 may determine the stage of processing for each document based on the URNs of the documents in obtained status updates.

The process 1200 may include evaluating whether the at least one document meets one or more pre-defined processing requirements related to the processing (1240). For example, the document tracking system 130 may obtain pre-defined processing requirements from the requirement database 134 and compare the progress of the processing of the documents to the obtained requirements.

The process 1200 may include reporting information about the stages of the processing of the at least one document based on the tracked progress and the evaluation (1250). For example, the document tracking system 130 may generate a summary showing the status of various documents, and provide alerts for documents for which an evaluation indicates that the processing of the document is likely to miss a KPI.

Figure 13:
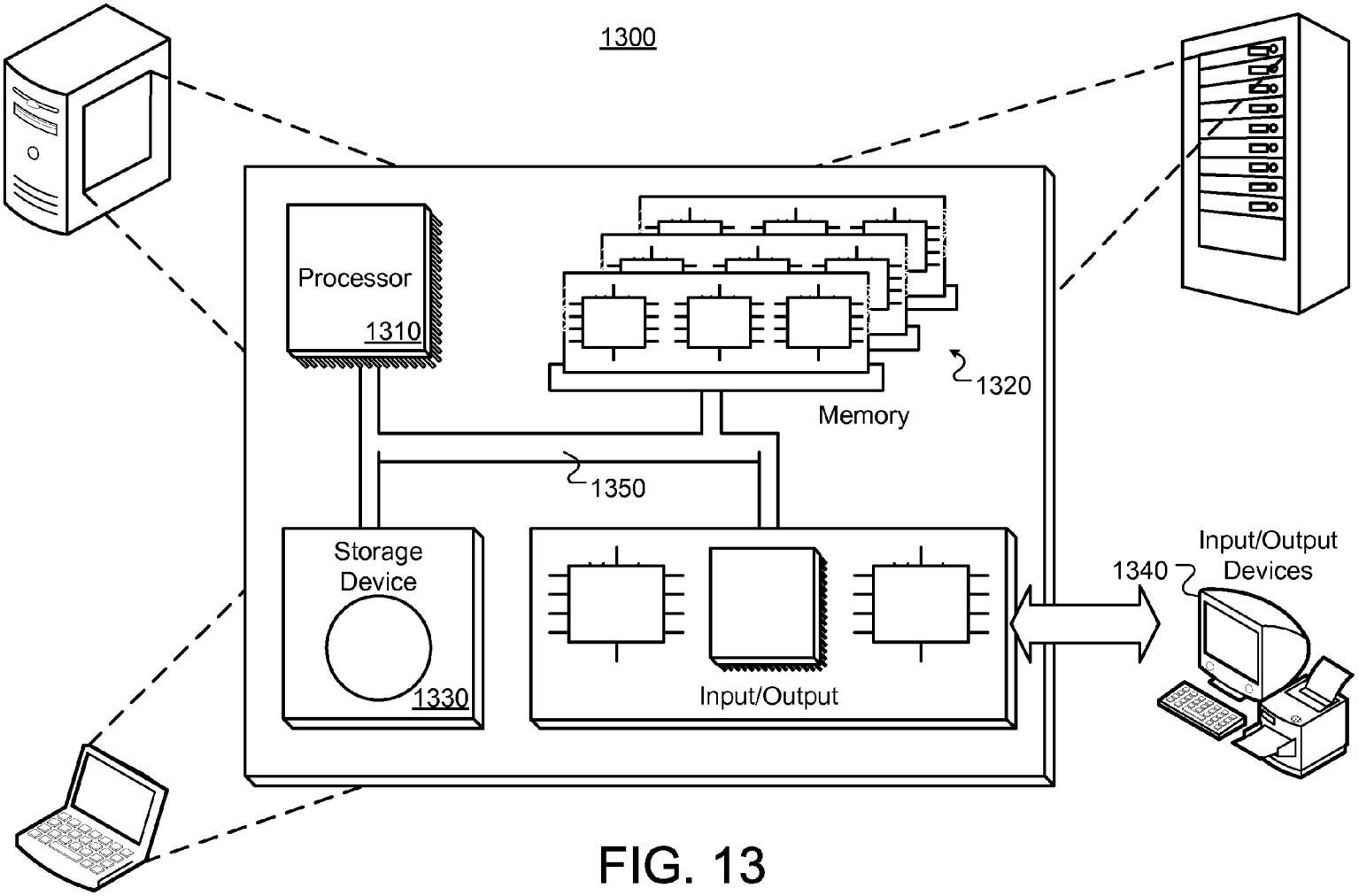
FIG. 13 illustrates a schematic diagram of an exemplary generic computer system.

FIG. 13 illustrates a schematic diagram of an exemplary generic computer system. The system 1300 can be used for the operations described in association with the process 1200 according to some implementations. The system 1300 may be included in the system 100.

The system 1300 includes a processor 1310, a memory 1320, a storage device 1330, and an input/output device 1340. Each of the components 1310, 1320, 1330, and 1340 are interconnected using a system bus 1350. The processor 1310 is capable of processing instructions for execution within the system 1300. In one implementation, the processor 1310 is a single-threaded processor. In another implementation, the processor 1310 is a multi-threaded processor. The processor 1310 is capable of processing instructions stored in the memory 1320 or on the storage device 1330 to display graphical information for a user interface on the input/output device 1340.

The memory 1320 stores information within the system 1300. In one implementation, the memory 1320 is a computer-readable medium. In one implementation, the memory 1320 is a volatile memory unit. In another implementation, the memory 1320 is a non-volatile memory unit.

The storage device 1330 is capable of providing mass storage for the system 1300. In one implementation, the storage device 1330 is a computer-readable medium. In various different implementations, the storage device 1330 may be a floppy disk device, a hard disk device, an optical disk device, or a tape device.

The input/output device 1340 provides input/output operations for the system 1300. In one implementation, the input/output device 1340 includes a keyboard and/or pointing device. In another implementation, the input/output device 1340 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, e.g., in a machine-readable storage device, for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network, such as the described one. The relationship of client and server arises by virtue of computer programs running on the respective computers and having a client-server relationship to each other.

A number of implementations have been described. Nevertheless, it will be understood that various modifications may be made without departing from the spirit and scope of the disclosure. For example, through the disclosure, the document processing system 110 and the document tracking system 130 generally are described as separate entities. However, in some implementations, the document processing system 110 and the document tracking system 130 may be implemented as part of a single computing system and/or the document processing system 110 and the document tracking system 130 may be implemented as the same computing device. Accordingly, other implementations are within the scope of the following claims.

What is claimed is:

1. A document tracking system comprising:

at least one processor; and at least one memory coupled to the at least one processor having stored thereon instructions which, when executed by the at least one processor, causes the at least one processor to perform operations comprising:

receiving, from a document processing system and through a communication network, document information for at least one document received for processing by the document processing system, the document processing system configured to process the at least one document in stages that are performed by at least two different applications operated by at least two separate hardware systems that are remote from the document tracking system, wherein each of the at least two different applications performs at least one same stage of the stages that are performed to process the at least one document;

receiving, from the document processing system and through the communication network, status updates indicative of a current stage of processing and a start time of the current stage of processing of the at least one document by the at least two different applications operated by the at least two separate hardware systems;

tracking a progress of the processing of the at least one document in each of the stages based on the status updates;

determining, based on the current stage and the start time of the current stage, whether a processing delay of the current stage is expected to exceed a processing delay limit; and transmitting, to a customer device and a service provider device through the communication network and based on a determination that the processing delay of the current stage is expected to exceed the processing delay limit, an alert indicating that the current stage is expected to exceed the processing delay limit.

2. The system of claim 1, wherein tracking the progress comprises tracking data that describes, for each of the at least one document, one or more completed stages of the stages, an in progress stage of the stages, and one or more next stages of the stages, and wherein transmitting the alert further comprises transmitting the tracking data.

3. The system of claim 1, wherein receiving the status updates comprises receiving, from each of the at least two separate hardware systems, the status updates associated with the stages performed by the at least two different applications operated by the at least two separate hardware systems.

4. The system of claim 1, wherein receiving the status updates comprises, for each stage that has been completed for a document, receiving the start time describing when processing of the document in the stage was begun and an end time describing when processing of the document in the stage was completed.

5. The system of claim 1, wherein receiving the status updates comprises, for each stage that has been begun processing for a document, receiving the start time describing when processing of the document in the stage was begun.

6. The system of claim 1, wherein receiving the status updates comprises receiving, for each stage, the unique reference number for each document being processed by the stage, wherein tracking the progress comprises, for each document, determining the stage of processing the document based on the unique reference number of the document in the status updates.

7. The system of claim 1, wherein receiving the document information comprises receiving at least one document or at least one indication that identifies at least one document received for processing by the document processing system.

8. The system of claim 1, wherein determining whether the processing delay of the current stage is expected to exceed the processing delay limit comprises:

comparing a progress of the processing to one or more processing requirements for the current stage;

detecting that the processing is estimated to fail to satisfy the one or more processing requirements based on the comparison; and generating an alert based on the detection.

9. The system of claim 8, wherein comparing comprises:

determining that an estimated processing time for remaining stages is greater than a time remaining for processing based on the one or more processing requirements.

10. The system of claim 9, wherein the operations further comprise:

determining the estimated process time for the remaining stages based on received status updates.

11. The system of claim 1, wherein receiving document information for at least one document received for processing by a document processing system comprises receiving document information for at least a physical paper, a writing conveying information, a computer file containing information, product packaging, images, or video.

12. The system of claim 1, wherein transmitting, to a customer device and a service provider device through the communication network, the alert comprises transmitting information, to the customer device, that enables the customer device to display to a user a summary of different documents being processed that have failed to satisfy one or more processing requirements.

13. The system of claim 1, wherein transmitting the alert comprises:

receiving a search query identifying the at least one document; and transmitting information regarding the progress of the at least one document in response to the query.

14. They system of claim 13, wherein transmitting the alert further comprises:

transmitting an interface to the customer device for a user to input the search query.

15. The system of claim 1, wherein transmitting the alert comprises:

transmitting a summary of processing progress of different documents by customer.

16. The system of claim 1, wherein the operations are performed in a real-time manner.

17. The system of claim 1, the system further comprising:

a status database storing the obtained status updates; and a requirement database storing the one or more processing requirements.

18. The system of claim 1, wherein the two different applications comprise different stages.

19. A method comprising:

receiving, from a document processing system and through a communication network, document information for at least one document received for processing by the document processing system, the document processing system configured to process the at least one document in stages that are performed by at least two different applications operated by at least two separate hardware systems that are remote from the document tracking system, wherein each of the at least two different applications performs at least one same stage of the stages that are performed to process the at least one document;

receiving, from the document processing system and through the communication network, status updates indicative of a current stage of processing and a start time of the current stage of processing of the at least one document by the at least two different applications operated by the at least two separate hardware systems;

tracking a progress of the processing of the at least one document in each of the stages based on the status updates;

determining, based on the current stage and the start time of the current stage, whether a processing delay of the current stage is expected to exceed a processing delay limit; and transmitting, to a customer device and a service provider device through the communication network and based on a determination that the processing delay of the current stage is expected to exceed the processing delay limit, an alert indicating that the current stage is expected to exceed the processing delay limit.

20. At least one computer-readable storage medium encoded with executable instructions that, when executed by at least one processor, cause the at least one processor to perform operations comprising:

receiving, from a document processing system and through a communication network, document information for at least one document received for processing by the document processing system, the document processing system configured to process the at least one document in stages that are performed by at least two different applications operated by at least two separate hardware systems that are remote from the document tracking system, wherein each of the at least two different applications performs at least one same stage of the stages that are performed to process the at least one document;

receiving, from the document processing system and through the communication network, status updates indicative of a current stage of processing and a start time of the current stage of processing of the at least one document by the at least two different applications operated by the at least two separate hardware systems;

tracking a progress of the processing of the at least one document in each of the stages based on the status updates;

determining, based on the current stage and the start time of the current stage, whether a processing delay of the current stage is expected to exceed a processing delay limit; and transmitting, to a customer device and a service provider device through the communication network and based on a determination that the processing delay of the current stage is expected to exceed the processing delay limit, an alert indicating that the current stage is expected to exceed the processing delay limit.

* * * * *